United States Patent [19]

Franke, Sr.

[11] Patent Number: 4,517,907

[45] Date of Patent: May 21, 1985

[54] DRIVEN WORK FOLDER

[75] Inventor: John M. Franke, Sr., Glendale, Calif.

[73] Assignee: The Singer Company, Stamford, Conn.

[21] Appl. No.: 611,240

[22] Filed: May 17, 1984

[51] Int. Cl.[3] ..... D05B 21/00; D05B 35/02

[52] U.S. Cl. ..... 112/121.15; 112/147

[58] Field of Search ..... 112/121.15, 2, 147, 112/136, 141, 143

[56] References Cited

U.S. PATENT DOCUMENTS 702,085 6/1902 Barnes ..... 112/136 X 1,081,206 12/1913 Burnham ..... 112/141

2,289,472 7/1942 Alfandre ..... 112/2

*Primary Examiner*—H. Hampton Hunter

*Attorney, Agent, or Firm*—Robert E. Smith; Edward L. Bell

[57] ABSTRACT

A device useful with robotic fabric manipulating systems for forming hemfolds in fabric panels and comprising a slotted mandrel simultaneously accommodating the entire fabric edges to be hemmed and a drive rotating said mandrel within a sheath which frictionally constrains the folded fabric being drawn from the mandrel during stitching.

10 Claims, 7 Drawing Figures

DRIVEN WORK FOLDER

BACKGROUND OF THE INVENTION

This invention relates to apparatus for automatic work fabric manipulation in the formation and stitching of a folded fabric seam. More particularly, this invention comprehends fabric folding instrumentalities specially adapted to accommodate robotic fabric insertion therein and automatic fabric control in the absence of operator influence during stitching of the folded fabric seam.

Conventional fabric folding guides adapted for use by a sewing machine operator are designed to exert localized influence on the work fabric in response to relative movement of the fabric thereto immediately in advance of the sewing machine stitching point. These prior art guides thus require complex fabric manipulation by the operator simultaneously to provide not only operator control of flow of the work fabric in the direction of the stitched seam, but also control of the lateral disposition of the fabric edge into the folding guide.

The complex manipulation requirements when compounded by the flexibility and other variables encountered in fabric manipulation can render prior art type folding instrumentalities unsuitable for robotic fabric manipulation.

It is an object of this invention to provide a novel fabric folding guide which is particularly well adapted to accommodate robotic fabric insertion therein and which moreover, exerts an advantageous stabilizing influence on the work fabric during sewing of the folded seam to facilitate successful completion of the stitching of the folded seam without human operator attention.

These objects of this invention are attained by the provision of a novel fabric folding guide which is adapted to accommodate one entire edge of one or more fabric plies in a translatory motion compatable with robotic fabric manipulation. The guide is subsequently driven to form the required fabric fold within a constraining sheath which applies a frictional influence on the fabric fold during the ensuing sewing operation so as to provide an advantageous steering effect on the fabric panel during the sewing.

With the above and additional objects and advantages in view as will hereinafter appear, this invention will now be described with reference to the accompanying drawings of preferred embodiments in which:

FIG. 1 is a perspective view showing apparatus in accordance with this invention for folding and sewing a folded seam on a fabric panel without human intervention, FIG. 2 is an enlarged cross-sectional view taken substantially along line 2—2 of FIG. 1 including a representation of a fabric panel introduced to the folder prior to operation of the folder to form a fold, FIG. 3 is a cross-sectional view similar to that of FIG. 2, but including a representation of the fabric panel after operation of the folder to form the fold, FIG. 4 is a cross-sectional view showing the finished seam resulting from the operation of the folder illustrated in FIGS. 1 to 3,

5 is a disassembled perspective view of the fabric folder of FIGS. 1–3, FIG. 6 is a cross-sectional view of a modified form of folder in accordance with this invention which is adapted to form a lap seam fell and FIG. 7 is a cross-sectional view showing the finished seam resulting from the operation of the folder of FIG. 6.

DESCRIPTION OF THE DRAWINGS

Referring to the drawings, there is illustrated in FIG. 1 a conventional sewing machine 11 including a work supporting bed 12, a bracket arm 13 overhanging the bed, a presser device 14 and an endwise reciprocable thread carrying needle 15 supported from the bracket arm for constraining and stitching work fabrics supported on the bed. Preferably the sewing machine includes stitch forming mechanism (not shown) cooperating with the needle, fabric feeding means (not shown) as well as ancillary devices (not shown) effective on command for starting and stopping the sewing machine, raising and lowering the presser device and trimming the sewing threads at the end of each seam formation, all of which devices may be of conventional construction well known in the sewing machine art.

Fabric panels 20 to be manipulated and stitched by the apparatus of this invention are stored in a stacking device 21 which includes a reference surface 22 against which one edge 23 of each of the fabric panels is oriented. The stacking device 21 may be of any conventional type including means (not shown) for maintaining the topmost fabric panel 20 at a predetermined elevation.

Figure 1:
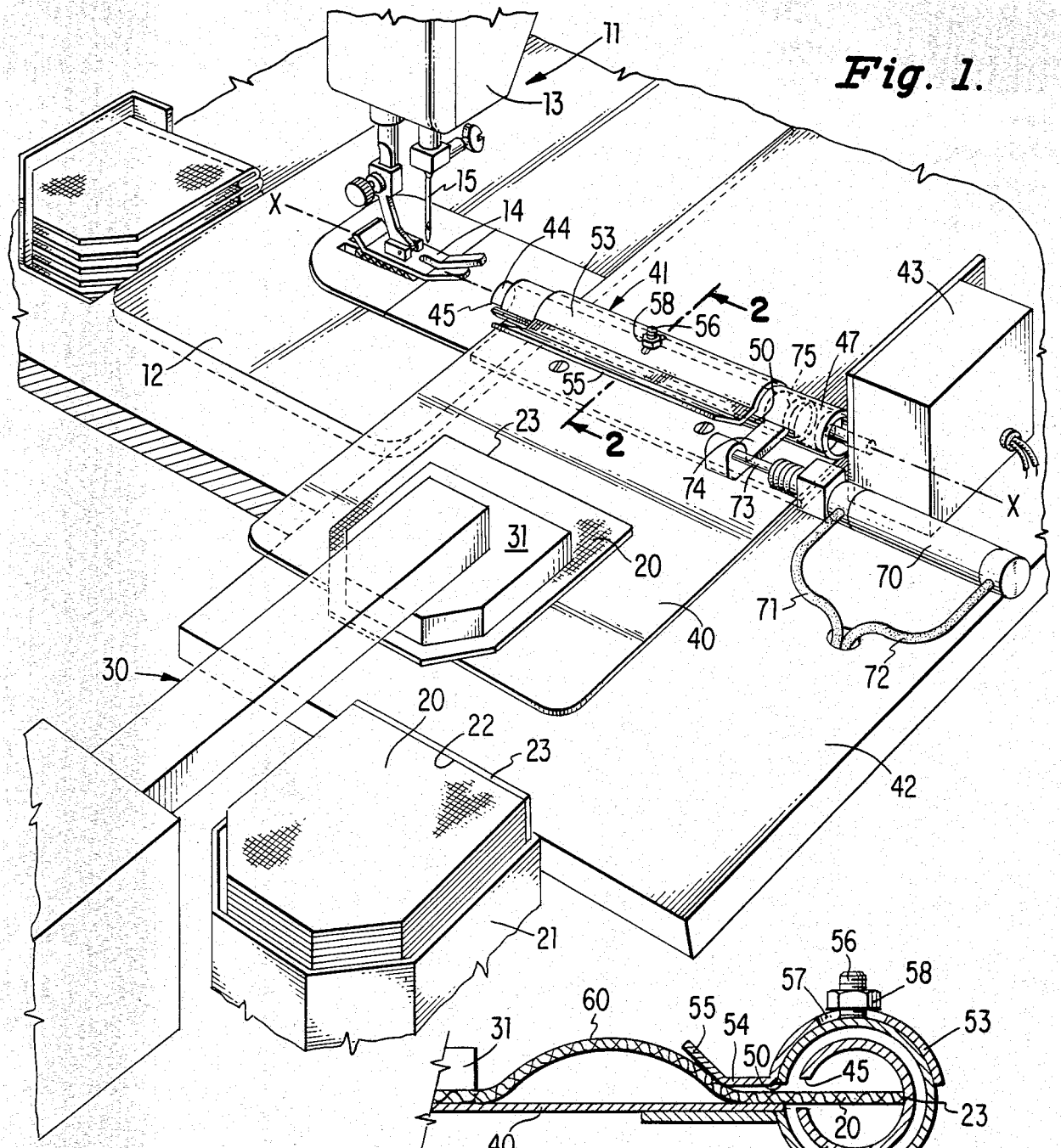

A robotic work fabric manipulator indicated generally at 30 is provided having an end effector 31 capable of selectively engaging or disengaging one of the fabric panels 20. The robotic manipulator 30 includes controls not only capable of influencing selective engagement and disengagement of the end effector with a fabric panel but also controls for imparting universal movement to the end effector 31. Such robotic controls may be of any known construction, the specific details of which do not form part of the present invention.

The robotic manipulator end effector 31 after engaging a fabric panel 20 from the stacking device 21 transports the fabric panel 20 onto a flat polished work supporting plate 40 which is associated with a work folding mechanism indicated generally at 41.

The work folding mechanism is carried on a base plate 42 and includes an electric rotary actuator 43 mounted on the base plate and operatively connected to a cylindrical mandrel 44 formed lengthwise with a slot 45 opening at one side of the mandrel. The mandrel 44 is accommodated within a cylindrical sheath 47 with clearance therebetween equal to substantially the thickness of one of the fabric panels 20.

Figure 2:
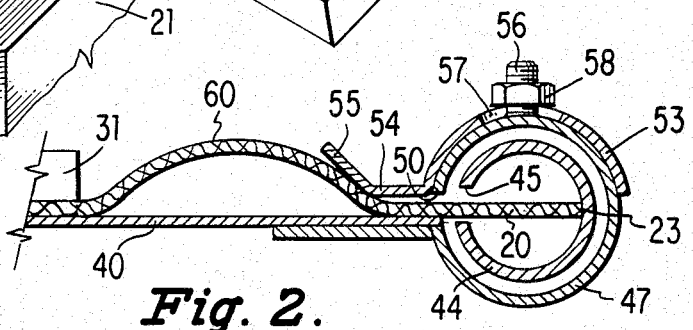
Figure 3:
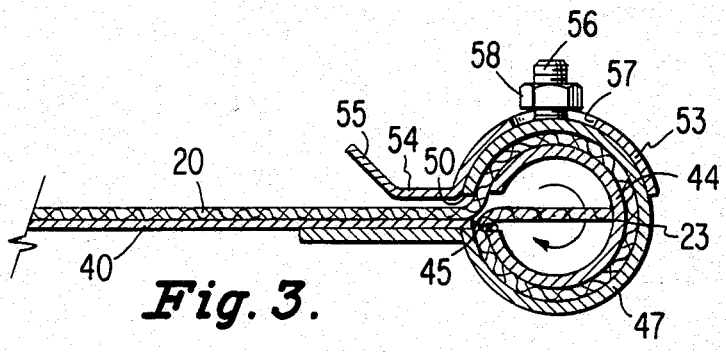
Figure 5:
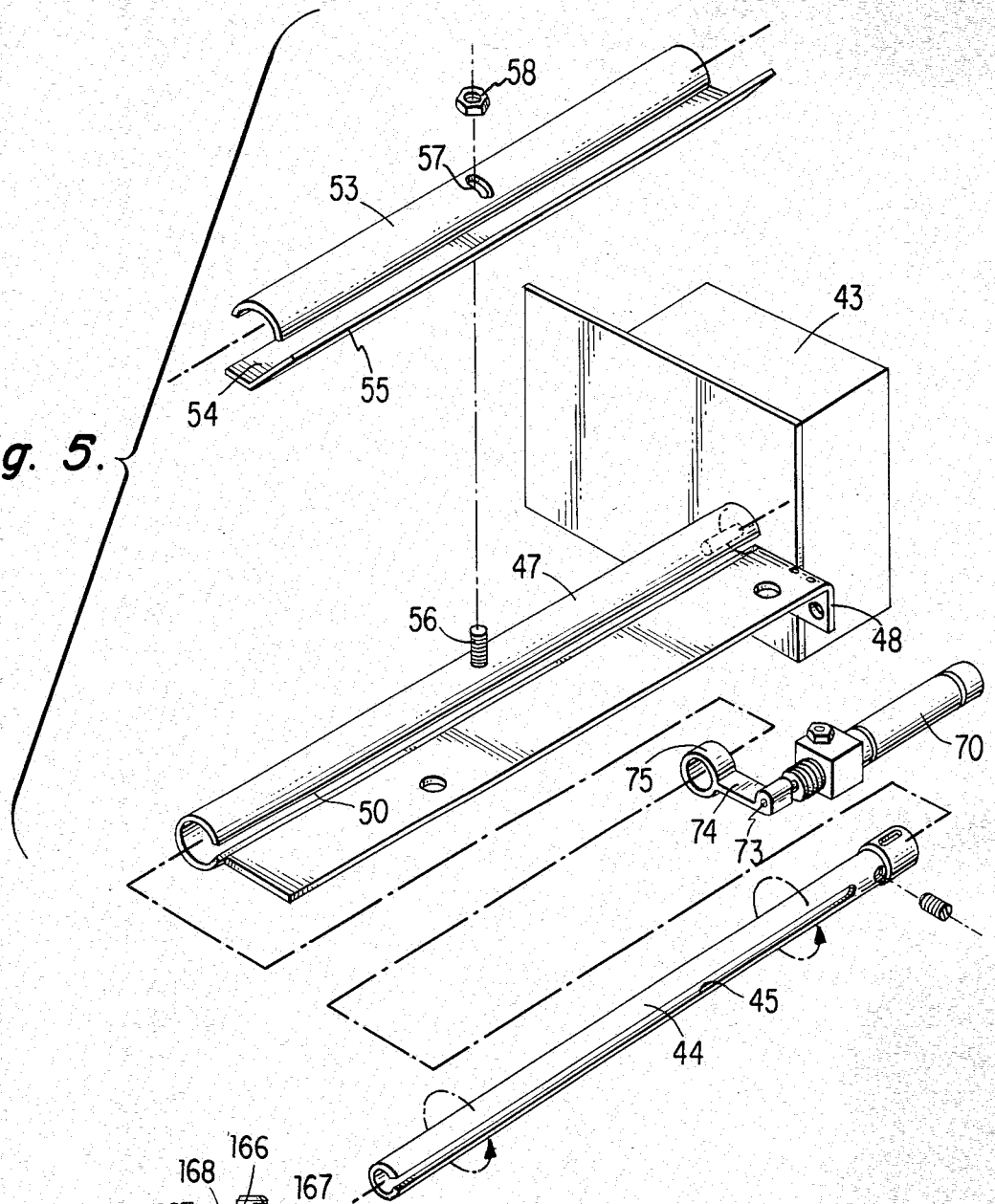

The sheath 47, which may be supported by a bracket 48 attached to the housing of the rotary actuator 43, is formed with a lengthwise slot 50 to accommodate insertion of fabric panel edges 23 therein. The work supporting plate 40, moreover, extends into the sheath slot 50 as shown in FIGS. 2 and 3 further to assist in directing the fabric panel edge therein. Over the sheath 47, a semicircular cover 53 is arranged having an outwardly extending lip 54 upturned at 55 at the free extremity. A threaded stud 56 extending upwardly from the sheath 47 is embraced by an elongated slot 57 in the cover so that the cover may be adjusted angularly on the sheath and held in selected position by tightening a nut 58 so as to set the device to accommodate fabrics of various thicknesses.

The rotary actuator 43 is preferrably organized and controlled so as to impart one full revolution increments of turning movement to the mandrel 44 upon command, terminating each full revolution increment with the mandrel slot 45 aligned adjacent to the sheath slot 50 as shown in FIGS. 2 and 3.

The robotic end effector 31 having engaged a fabric panel 20 in a predetermined orientation in the stacking device 21 and having transported the fabric panel onto the support plate 42, shifts the fabric panel on the support plate first into a position in which the fabric panel edge 23 is parallel to the lengthwise axis of the mandrel 44 and then shifts the fabric panel in translatory motion toward the mandrel until the fabric panel edge 23 is accommodated fully into the mandrel through the mandrel slot 45. Preferably, an additional increment of such translatory motion is thereafter transmitted to the fabric panel 20 causing a surplus of fabric to bulge upwardly immediately adjacent to the mandrel as shown at 60 in FIG. 2. The amount of such additional fabric movement is preferably made equal to the circumference of the mandrel cross-section so that as the mandrel is turned for one revolution after the fabric has been positioned as shown in FIG. 2 the fabric panel edge 23 will not be withdrawn laterally out of the slot 45. As an alternative to introducing a surplus of fabric before rotation of the mandrel as described above, the operation of the rotary actuator may be initiated when the robotic end effector has completed fully inserting the fabric panel into the mandrel but before any surplus bulge 60 is formed in the fabric. The robotic end effector may then be shifted toward the mandrel during rotation of the mandrel and at a rate just sufficient to supply the fabric consumed in the formation of the fold in the fabric by rotation of the mandrel.

In one preferred embodiment of this invention, as illustrated in FIG. 1, the base plate 42 of the work folding mechanism may be secured in a fixed position relatively to the sewing machine 11 with the axis X—X of the mandrel arranged in alignment with the line of stitching formed by the sewing machine and the free extremity of the mandrel located slightly in advance of the presser foot 14.

The length of the mandrel slot 45 is slightly longer than the dimension along the fabric panel edge to be folded so that folding of the entire fabric edge 23 is accomplished simultaneously and while the entire fabric edge is arranged within the folding device.

An ejector mechanism is provided operative to shift the folded fabric edge slightly beyond the work folding mechanism so that the influence of the sewing machine on the exposed folded fabric may be initiated. For this a double acting cylinder 70 is carried by the base plate 42 alongside the rotary actuator 43 and supplied by supply lines 71 and 72 from any suitable source of air under pressure. A piston rod 73 extending from the air cylinder carries a lateral blade 74 which at its free extremity extends into the sheath slot 50 where it carries a fabric engaging loop 75 arranged between the mandrel 44 and the sheath 47.

After the fabric panel edge has been introduced to the mandrel slot 45 and the mandrel 44 has been imparted one full revolution so that the fabric edge has been folded as shown in FIG. 3, the air cylinder 70 is activated to advance the loop 75 toward the sewing machine needle so as to shift the work fabric relatively to the folding mechanism and cause the folded edge to protrude outwardly beyond the folding mechanism and beneath the presser foot 14 which has been raised to accommodate fabric introduction therebeneath. As alternative to the air cylinder 70, an electric solenoid or similar actuator might be employed to effect this lateral shift of the folded work panel to protrude slightly beyond the free extremity of the folder.

Thereafter, the presser foot of the sewing machine is lowered onto the folded fabric panel edge protruding from the folder 41 and subsequent operation of the sewing machine serves by way of the sewing machine work feeding mechanism to advance the work fabric past the stitching point during stitching of the securing seam 80.

Figure 4:
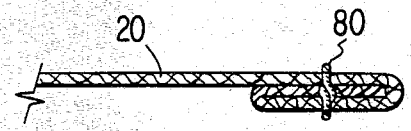

The hem shown in FIG. 4 which is formed by operation of the apparatus shown in FIGS. 1–3 is of the Federal standard hem type EFb1 although numerous variations are possible such as parallel lines of securing stitches by use of multiple needle sewing machines, the inclusion of tags labels, lining fabrics and the like.

After completion of hem sewing and before insertion of the succeeding work panel into the folder, the air cylinder 70 is actuated in reverse to return the loop 75 into readiness to receive the succeeding work piece.

The frictional effect of the work folding mechanism 41 on the fabric panel 20 as the fabric panel is drawn out of the folding mechanism during sewing of the seam provides a constraining and steering influence on the fabric panel. The location of the axis of the mandrel substantially in the line of stitches formed by the sewing machine results in a guiding influence on the entire fabric panel in a translatory fashion parallel to the line of stitch formation of the sewing machine particularly for relatively small panel pieces such as pockets, cuffs and the like. Where such steering effect is found to guide the fabric piece satisfactorily, the end effector 31 of the robot 30 may be disengaged from the fabric panel prior to any movement of the fabric panel parallel to the axis of the mandrel 44.

Where conditions of fabric size, shape or flexibility are found to be such that the steering effect of the folding mechanism 41 is insufficient to cause the entire fabric panel to move in translation, the robotic end effector 31 may be maintained in engagement with the fabric panel during sewing of the seam and moved first in concert with the air cylinder actuated loop 75 and then in concert with the work transporting action of the sewing machine.

Instead of being supported in fixed location relatively to the sewing machine 11, the work folding mechanism 41 may be shiftably supported for bodily movement between the position shown in FIG. 1 and another position (not illustrated) spaced from the sewing machine. Such bodily shiftable support for the work folding mechanism may, for instance, accommodate the transfer of fabric panels thereto more conveniently. Where the work folding mechanism is bodily shiftable, a further option is available to provide a similar or common bodily shiftable support for the robotic end effector. Where assist of the robotic end effector during sewing is not required, a common bodily shiftable support for the robotic end effector is not required and the end effector may be released from the fabric panel after the fabric edge has been folded but before bodily shift of the work folding mechanism into the position illustrated in FIG. 1.

Figure 6:
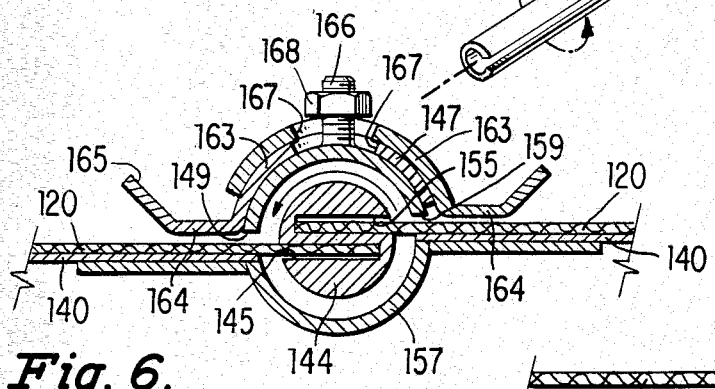
Figure 7:
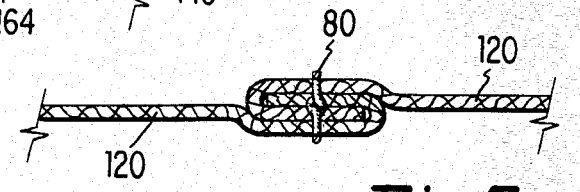

FIG. 6 illustrates the cross-sectional shape of a mandrel and sheath of a modified form of work folding mechanism 41 and FIG. 7 shows a folded seam which may be produced by this modified folder. The mandrel 144 in FIG. 6 may be operatively connected to a rotary actuator 43 as in the form of construction illustrated in FIG. 1, however, the mandrel 144 is formed with two substantially diametrically opposed slots 145, 155, i.e. the slots open on opposite sides of the mandrel. Sleeve parts 147 and 157 are supported and arranged so as to define slots 149 and 159 between the sleeve parts, one slot at each side, and each slot aligned with one of the mandrel slots 145, 155, respectively, between half rotation increments of the mandrel. A pair of covers 163 each with a lip 164 having an upturned extremity 164 may be secured for limited adjustment on the upper sleeve part 147 by a stud 166 fixed to the sleeve part 147 which stud extends through an elongated slot 167 in each cover 163 to be secured in selected position thereon by a nut 168.

The mandrel 142 is thus adapted simultaneously to enfold the edges of two fabric plies 120, 120 into a configuration referred to in the art as a lap seam fell Federal Standard seam type LSc-1 as shown in FIG. 7. To do this, the two fabric plies 120, 120 are directed toward the mandrel from opposite sides thereof preferably each by the action of an individual robotic end effector (not shown). Separate work supporting plates 140, 140 may be provided to accommodate the work fabric plies one at each side. Thereafter operation of the system to complete sewing of the folded seam may proceed as described above with regard to the previously described embodiment except that the rotary actuator 43 is controlled so as to impart only half revolution increments of turning movement to the mandrel 144, one increment during the formation of each lap seam. Similarly, the various options described earlier may be employed as required or desired with the modified form shown in FIGS. 6 and 7.

I claim:

1. An automatically operable work fabric manipulating device for folding and delivering to the stitching point of a sewing machine one edge of a fabric panel, comprising:

a mandrel rotatable about a lengthwise axis;

said mandrel being formed with a fabric accommodating slot extending parallel to the lengthwise axis thereof, and having a mouth opening at one side of said mandrel;

drive means for rotating said mandrel to form a fold in a fabric panel edge inserted in said mandrel slot, said drive means operatively connected to said mandrel adjacent one lengthwise extremity of said slot;

said slot extending continuously to the other and free extremity of said mandrel;

a sheath surrounding at least a portion of said mandrel and providing for frictional engagement of a work fabric panel interposed therebetween by the rotation of said mandrel;

and means for sustaining said mandrel axis in substantial alignment with the line of stitch formation of said sewing machine during sewing of a line of stitches by said sewing machine in said folded fabric panel edge.

2. An automatically operable work fabric manipulating device as set forth in claim 1 in which said sheath is formed with a fabric accommodating opening arranged parallel to said mandrel slot, and in which said drive means is adapted to impart an increment of turning movement to said mandrel during each fabric manipulating operation from a mandrel position in which said mandrel slot is arranged adjacent to and in communication with said sheath opening.

3. An automatically operable work fabric manipulating device as set forth in claim 2 in which said mandrel is formed with only a single slot, in which said slot is formed with only a single opening, and in which said drive means is adapted during each fabric manipulating operation to impart one full revolution of turning movement to said mandrel beginning and terminating with said mandrel position with said slot being arranged adjacent to an in communication with said sheath opening.

4. An automatically operable work fabric manipulating device as set forth in claim 2 in which said mandrel is formed with two slots, said slots opening on diametrically opposite sides of said mandrel, in which said sheath is formed with two openings arranged on diametrically opposite sides of said sheath, and in which said drive means is adapted during each fabric manipulating operation to impart one half revolution of turning movement to said mandrel shifting said mandrel slots alternately into position adjacent to and in communication with opposite ones of said sheath openings.

5. An automatically operable work fabric manipulating device as set forth in claim 2 in which said mandrel slot extends for a distance lengthwise along said mandrel at least equal to that of the folded seam being formed in the fabric panel, and in which an ejector is provided for shifting a folded work fabric panel lengthwise along said mandrel to proturde beyond the free extremity thereof, said ejector comprising a fabric engaging element arranged in the space between said mandrel and said sheath adjacent the drive means connection with said mandrel, an actuator for imparting translatory motion to said fabric engaging element, and a connection between said actuator and said fabric engaging element extending through said sheath opening.

6. An automatically operable work fabric manipulating device as set forth in claim 2 in combination with a work fabric supporting tray defining a work supporting surface terminating closely adjacent said fabric accommodating sheath opening and arranged in a plane intersecting said sheath opening, and a robotic work transporting device including a fabric gripping end effector, effective to transport a fabric panel onto said tray, orient said fabric panel on said tray with a fabric edge parallel to said sheath opening, and impart translatory movement to said fabric panel toward said work fabric manipulating device to introduce the entire fabric edge simultaneously into said mandrel slot.

7. An automatically operable work fabric manipulating device as set forth in claim 4 in which said robotic work transporting device also includes means for imparting continued translatory movement to said fabric panel toward said work fabric manipulating device after said fabric edge has been inserted completely into said mandrel slot for a distance substantially equal to the circumference of said mandrel.

8. An automatically operable work fabric manipulating device as set forth in claim 7 in which said continued translatory movement imparted to said fabric panel toward said work fabric manipulating device by said means is completed prior to operation of said drive means for rotating said mandrel.

9. An automatically operable work fabric manipulating device as set forth in claim 7 in which said means for imparting continued translatory movement to said fabric panel toward said work fabric manipulating device is effected during operation of said drive means for rotating said mandrel and at a rate equal to that which the rotating mandrel wraps fabric about its periphery.

10. An automatically operable work fabric manipulating device for folding and delivering to the stitching point of a sewing machine enfolded edges of a fabric panel, comprising:

a mandrel rotatable about a lengthwise axis;

said mandrel being formed with a plurality of fabric accommodating slots each extending parallel to the lengthwise axis thereof, said slots each having a mouth, said mouths opening in equally spaced relation to each other circumferentially about said mandrel, drive means for rotating said mandrel to form enfolded edges of fabric panels inserted in said mandrel slots, said drive means operatively connected to said mandrel adjacent one lengthwise extremity of said slots;

said slots extending continuously to the other and free extremity of said mandrel;

a sheath surrounding at least a portion of said mandrel and providing for frictional engagement of work fabric panels interposed therebetween by the rotation of said mandrel;

and means for sustaining said mandrel axis in substantial alignment with the line of stitch formation of said sewing machine during sewing of a line of stitches by said sewing machine in said enfolded edges of said fabric panels.

* * * * *